United States Patent [19]

Vitt

[11] 3,935,667

[45] Feb. 3, 1976

[54] AMUSEMENT DEVICE

[76] Inventor: Louis O. Vitt, 1235 S. Green Road, South Euclid, Ohio 44121

[22] Filed: Feb. 25, 1974

[21] Appl. No.: 445,683

[52] U.S. Cl. ..... 46/202; 46/216; 273/86 R

[51] Int. Cl. ..... A63h 18/06

[58] Field of Search ..... 46/1 R, 1 K, 59, 61, 62, 46/202, 216, 132, 228; 273/86 R, 86 B

[56] References Cited

UNITED STATES PATENTS

| | | | |
|---|---|---|---|
| 1,854,876 | 4/1932 | Anzalone | 46/62 |
| 1,973,549 | 9/1934 | Then | 46/62 |
| 3,000,138 | 9/1961 | Tagliaferri | 46/228 |
| 3,402,504 | 9/1968 | Steube | 46/59 |
| 3,501,860 | 3/1970 | Bandy | 46/62 |
| 3,611,632 | 10/1971 | Smith | 46/202 |

*Primary Examiner*—Russell R. Kinsey
*Assistant Examiner*—Robert F. Cutting
*Attorney, Agent, or Firm*—Teare, Teare & Sammon

[57] ABSTRACT

An amusement device having a housing which supports a rotatable member, such as a shaft. A power unit is supported by the housing for rotating the shaft. Track means is provided which includes one or more elongated, flexible track elements for selective frictional engagement with the shaft. Each track element comprises a cord which is wrapped about the shaft such that its opposite ends project in opposite directions therefrom. When tension is applied to the opposite ends of the cord, the cord will frictionally engage the shaft in clutching relation which tends to cause the housing to move in a direction which depends upon the direction of wrap of the cord on the shaft. When two cords are used, they are wrapped in reverse direction on the shaft so as to enable movement of the housing back and forth along the cords. The direction of movement along the cords will depend upon the direction of wrap of the cord having the greatest tension applied thereto. The device may be maintained in a stationary position when tension in both cords is equal, even though the shaft may continue to rotate.

10 Claims, 5 Drawing Figures

AMUSEMENT DEVICE

BACKGROUND OF THE INVENTION

The present invention relates to amusement devices, and more particularly, to a powered amusement device which is controlled for lateral movement along a flexible track element, or elements, such as a cord, or the like, to produce a "Yo-Yo" type movement.

Numerous amusement devices have been devised where an object is controlled by the manual manipulation of one or more cords connected thereto. One good example would be the well known Yo-Yo. Other devices are known where cords are connected to an object to create a whirling or spinning movement to the object. Generally, these latter devices have relied on the manual twisting of a pair of cords which causes the object to rotate as a result of the natural tendency of the cords to untwist. In these devices, the object is not supported for lateral movement along the lengthwise direction of the control cords in a manner such that the movement of the object in opposite directions along the cord or cords can be commenced and terminated at will so as to perform many various functions.

REFERENCE TO PRIOR ART PATENTS

| | | |
|---|---|---|
| Anzalone | U.S. Pat. No. 1,854,876 | April 19, 1932 |
| Then | U.S. Pat. No. 1,973,549 | Sept. 11, 1934 |
| Bandy | U.S. Pat. No. 3,501,860 | March 24, 1970 |

SUMMARY OF THE INVENTION

The present invention contemplates a new and novel amusement device having a housing which supports a rotatable member, such as a shaft, thereon. A power unit is supported on the housing for rotating the shaft. A track means is provided which includes one or more elongated, flexible track elements for selective frictional engagement with the shaft. Each track element comprises a cord which is wrapped about the shaft such that its opposite ends project in opposite directions therefrom. When one cord is used, the application of tension to its opposite ends will cause it to frictionally engage the shaft, tending to cause the housing to move in a direction which depends upon the direction of wrap of the cord on the shaft. When two cords are used, they are wrapped in reverse directions around the shaft and the housing will move in the direction determined by the direction of wrap of the cord having the greatest tension applied thereto. Thus, the direction of movement of the housing along the cords is determined by which cord has the greatest tension therein, or if the tension in both cords is equal, the body can be maintained in a stationary position on the cords even though the shaft may continue to rotate.

As can be seen, the device 1 readily lends itself to competitive racing events. For example, competitive races can be held which time the movement of the device over a predetermined distance against a clock, or when two devices are set up side-by-side, drag races or hill climbing races are possible. Even multiple-lap races can be held by racing the devices back and forth between pylon markers set up near the supported ends of the cord, or obstacle course races are possible, which will require a substantial length of cord and considerable manual dexterity and skill on the part of the operator, resulting in considerable fun and excitement.

DESCRIPTION OF THE PREFERRED EMBODIMENTS

Figure 1:
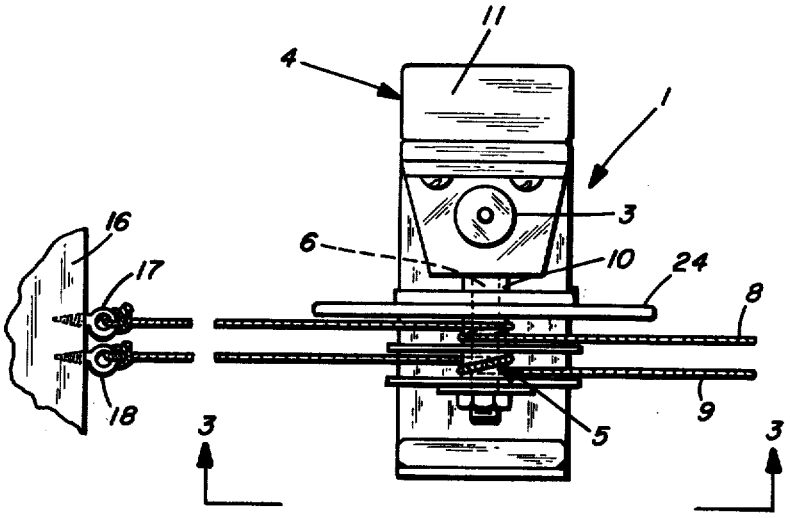
FIG. 1 is a top plan view of the amusement device of the present invention.
Figure 2:
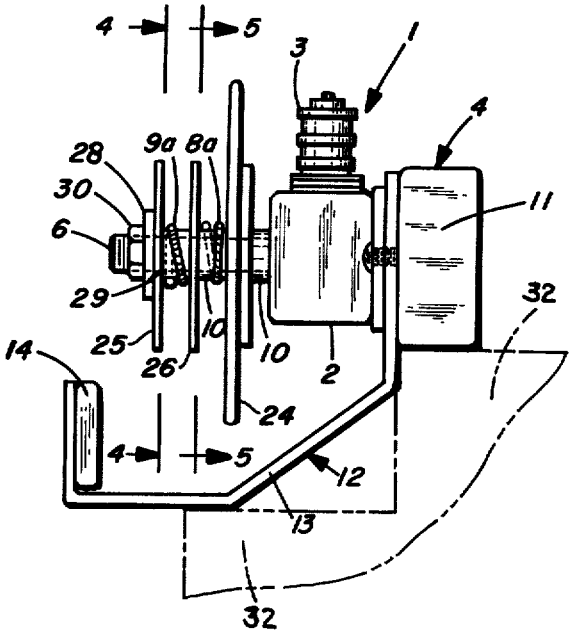
FIG. 2 is a side elevation view of the amusement device of the present invention as seen from the right hand side of FIG. 1.

Referring now to FIGS. 1 and 2, the amusement device of the present invention is illustrated, generally at 1, and is shown in the mounted operational position. The device 1 includes a power unit 4 having a rotatable drive shaft 6. A track assembly 5 is provided which includes a pair of flexible track elements, such as cords 8 and 9, which are wrapped about the shaft 6 and extend outwardly in opposite directions therefrom. The cords 8 and 9 are supported at their opposite ends, being adapted to have tension applied thereto, such as by pulling or the like, to cause a compressive frictional engagement of the cords 8 and 9 with the shaft 6. As shown, the cords 8 and 9 are wrapped in reverse direction on the shaft so that when tension is applied thereto, and the tension in one cord, such as 8, is greater than the tension in the other cord, such as 9, the device will move in one lateral lengthwise direction along the cords, and vice versa. By maintaining sufficient but equal tension in the cords, the device can be stopped by allowing the shaft to slip relative to the cords, and then be maintained in a stationary position on the cords 8 and 9 until the tension again becomes unequal thereon. Further, by controlling the tension in the cords 8 and 9, the speed of movement of the device 1 along the cords 8 and 9 can be varied.

In the form shown in FIGS. 1 and 2, the power unit 4 is supported by a housing 2 and is shown as being self-contained, such as a small gasoline engine 3 of the type generally used to power model airplanes or cars. The housing 2 includes a fuel tank 11 for supplying fuel to the engine 3. The shaft 6 projects outwardly from one side of the housing 2 for engagement with the cords 8 and 9. The shaft 6 may include a tubular sleeve 10 of a material having a greater coefficient of friction than steel to provide better frictional contact with the cords 8 and 9, and thus, provide more precise control for the device 1. Of course, it is obvious that other forms of power units could be utilized for rotating the shaft 6. For example, a battery-powered motor or gyroscope could be employed without departing from the scope and intent of the invention.

A stabilizing assembly 12 is provided for counterbalancing the weight of the housing 2 to maintain the rotational axis of the shaft 6 in a proper attitude or orientation, such as in a generally horizontal position, to enable riding movement of the device 1 along the cords 8 and 9 while being supported solely by the cords 8 and 9. In the form shown, the stabilizing assembly 12 includes an elongated arm 13 which is connected at one end to the housing 2 and is free at its opposite end. The arm 13 extends downwardly and away from the housing 2 in a direction toward the cords 8 and 9, being weighted at its free end, such as by a weight 14. Of course, it is understood that the position and size of the weight 14 will be dependent on the size and weight of the power unit 4. It should be further understood that other stabilizing arrangements may be utilized in lieu of the counterbalancing arrangement. For example, the power unit 4 could be supported, such as on wheels or rollers, for rolling movement along a support surface, such as the track, table or floor, without departing from the scope and intent of the invention.

As stated, the track assembly 5, in the form shown, includes a pair of cords 8 and 9 which are wrapped about the shaft 6 each has its opposite ends projecting in opposite directions from the shaft 6 being supported in any suitable manner for applying tension thereto. The device 1 may be operated by any number of persons, but when the device is operated by one person, one end of each cord 8 and 9 may be connected to a support member 16, such as a wall, or the like, being tied to the eyelets of screws 17 and 18, respectively, fastened to the wall 16. The opposite ends of the cords 8 and 9 may remain free for grasping by the operator or may also be fastened to another support assembly (not shown) having some provision for adjusting the tension on the cords 8 and 9.

Figure 3:
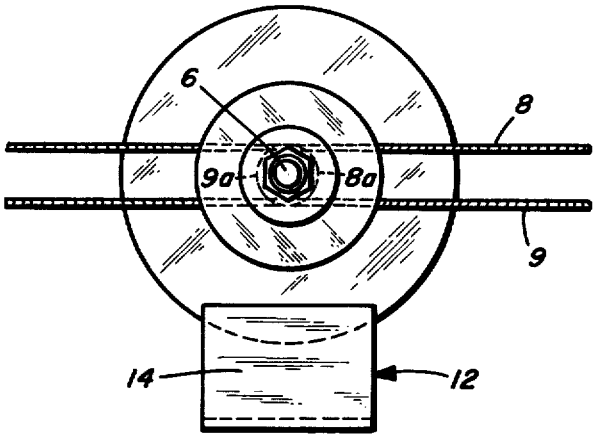
FIG. 3 is a front elevation view of the amusement device of the present invention taken along the lines 3—3 of FIG. 1.
Figure 4:
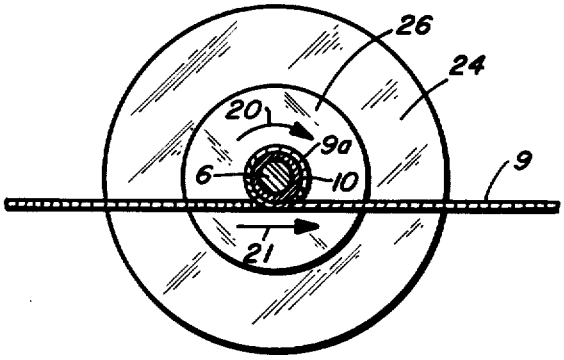
FIG. 4 is a transverse sectional view taken along the line 4—4 of FIG. 2.
Figure 5:
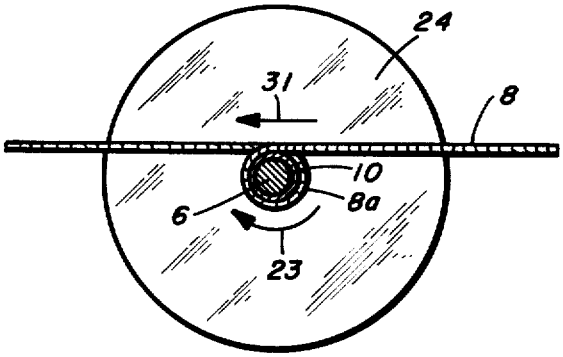
FIG. 5 is a transverse sectional view taken along the line 5—5 of FIG. 2.

The reverse wrapping of the loops 8*a* and 9*a* is best seen in FIGS. 3, 4 and 5. More particularly, the loops 8*a* and 9*a* are wrapped a full turn, or 360°, around the shaft so that the opposite ends of the cords 8 and 9 leave tangentially from opposite sides of the shaft 6, or 180° apart from one another. The outwardly extending portions of the cords 8 and 9 should be maintained in substantially parallel relation to achieve best results in the performance of the device 1. As shown in FIG. 4, the cord 9 is brought under and wrapped once around the shaft 6, and then leaves at the bottom side thereof. Thus, when the shaft 6 rotated in one direction, such as in the clockwise direction, as indicated by the arrow 20, the shaft 6 will tend to unwrap from cord 9. The loop 9*a* will shift along the cord 9 and remain around the shaft 6 causing the housing 2 to move to the right, such as indicated by the arrow 21. On the other hand, the cord 8 is wrapped once around the shaft 6 and leaves the top side thereof so that rotation of the shaft 6 in the clockwise direction, as indicated by the arrow 23, will cause the housing 2 to move to the left, as indicated by the arrow 31. Of course, the present invention can be carried out by the use of only one cord, but such would result in a movement of the device 1 in only one direction, unless the direction of rotation of the shaft 6 is reversed.

Retaining means 24 is provided to retain the cords 8 and 9 on the shaft 6, and thus, guide the device 1 along the cords 8 and 9. In the form shown, the retaining means 24 includes a flywheel 24 and a pair of discs 25 and 26 mounted in laterally spaced relation on the shaft 6. The flywheel 24 is fixedly connected to the shaft 6, such as by keying or the like, and the discs 25 and 26 are mounted laterally outwardly from the flywheel, being disposed in loose fitted relation on the sleeve 7. This arrangement allows the sleeve 7 to rotate freely with respect to the discs 25 and 26, and allows the discs 25 and 26 to shift laterally back and forth in the lengthwise direction of the shaft 6. The sleeve 7 is foreshortened with respect to the outer end of the shaft 6, and a washer 28 is fitted over the outer end of the shaft 6 for abutting engagement with the outer end of the sleeve, such as at 29, to limit the outward movement of the disc 25 along the shaft 6. The outer end of the shaft 6 may be threaded, and a nut 30 is threaded onto the shaft 6 which, when tightened, holds the washer 28 tightly against the outer end of the sleeve 7. The discs 25 and 26 are disposed on opposite sides of the cord 9, while the disc 26 and flywheel 24 are disposed on opposite sides of the cord 8. This arrangement allows the discs 25 and 26 to shift freely along the length of the shaft 6 to prevent binding with the cords 8 and 9. In addition, the discs 25 and 26 may be made of a flexible material, such as plastic or the like, to further reduce the possibility of binding.

In starting the engine 3, a stand (shown by phantom lines at 29 in FIG. 2), may be provided for supporting the device 1. With the cords 8 and 9 relaxed, the engine 3 may be started in a conventional manner by rotating the flywheel 24. This can be accomplished by applying a separate rotating wheel 24 for cranking the engine 4. Once the engine 4 is started, the operator can then grasp the free ends of the cords 8 and 9, and by applying tension thereto, cause the device 1 to be lifted from the stand 32, positioning the device so that it may ride freely on the cords 8 and 9. The procedure for stopping the device 1 would be essentially the reverse of the above. That is, the device 1 is moved along the cords 8 and 9 until it is in a position above the stand 32. It may then be lowered by relaxing the cords 8 and 9 until it rests on the stand 32. At this time, the separate rotating wheel, or suitable object, may be applied so as to contact the flywheel to oppose its direction of rotation, and thus, cause the engine to stall upon application of sufficient force thereto.

I claim:

1. An amusement device comprising, a housing, a rotatable member mounted for rotation on said housing, track means including at least one elongated, flexible track element, said track element being wrapped around said rotatable member for frictional engagement therewith for moving said housing along said track element, power means connected to said rotatable member for rotating said rotatable member in one direction, said track element having its opposite ends extending tangentially and in generally opposite directions from generally one side of said rotatable member whereby upon the application of tension to said track element a frictional force will result between said track element and said rotatable member to cause said housing to move along said track element at a speed related to the frictional force between said track element and said rotatable member, said track means includes a pair of track elements wrapped about said rotatable member, one of said track elements is wrapped around said rotatable member having its opposite ends extending generally tangentially from generally one side of said rotatable member, and the other of said track elements is wrapped around said rotatable member having its opposite ends projecting tangentially from a generally diametrically opposite side of said rotatable member from said one side whereby said housing can move in one direction when the frictional force between said one track element and said rotatable member exceeds the frictional force between said other track element and said rotatable member and can move in the opposite direction when the frictional force between said other track element and said rotatable member exceeds the frictional force between said one track element and said rotatable member.

2. An amusement device comprising, a housing, a rotatable member mounted for rotation on said housing, track means including a pair of elongated, flexible track elements wrapped around said rotatable member for frictional engagement with said rotatable member for moving said housing along said track elements, said track elements having their opposite ends projecting in generally opposite directions from said rotatable member for applying a tension thereto to cause frictional engagement with said rotatable member, power means connected to said rotatable member for rotating said rotatable member in one direction, one of said track elements having its opposite ends extending tangentially to one side of said rotatable member, and the other of said track elements having its opposite ends extending generally tangentially to a generally diametrically opposite side of said rotatable member from said one side thereof whereby said device will move in one direction along the track elements when the frictional force between said one track element and said rotatable member is of a magnitude to allow slippage therebetween and is less than the frictional force between the other track element and the rotatable member, and will move in the opposite direction under reverse conditions and will remain at a standstill position when the frictional force between the one track element and the rotatable member is substantially equal to the frictional force between the other track element and the rotatable member while the rotatable member is rotating in said one direction.

3. A device in accordance with claim 2, wherein each of said track elements comprises an elongated cord adapted to be supported at its opposite ends for applying tension thereto.

4. A device in accordance with claim 2, including retaining means on said rotatable member disposed on between said track elements for maintaining said rotatable member in engagement with said track elements.

5. A device in accordance with claim 2, wherein said housing is supported in riding relation solely on said track elements, and stabilizing means is mounted on said housing for maintaining said housing in proper orientation for riding movement on said track elements.

6. A device in accordance with claim 4, wherein said retaining means comprises at least one pair of discs mounted in laterally spaced relation on said rotatable member, and said discs are mounted on opposite sides of at least one of said track elements.

7. A device in accordance with claim 5, wherein said rotatable member comprises a shaft, and said stabilizing means comprises a counterbalancing weight assembly for counterbalancing the weight of said housing to maintain said shaft in a generally horizontal position on said track elements.

8. A device in accordance with claim 2, including a flywheel mounted on said rotatable member being adapted for engagement with a separate rotating member for starting said device and stopping said device.

9. An apparatus in accordance with claim 6, wherein said discs are made of a resilient material to prevent binding contact with said track element.

10. A device in accordance with claim 2, wherein said power means comprises a gasoline engine.

* * * * *